US008102355B2

(12) United States Patent
Woo et al.

(10) Patent No.: US 8,102,355 B2
(45) Date of Patent: Jan. 24, 2012

(54) SOURCE DRIVER CAPABLE OF REMOVING OFFSET IN DISPLAY DEVICE AND METHOD FOR DRIVING SOURCE LINES OF DISPLAY DEVICE

(75) Inventors: Jae-hyuck Woo, Osan-si (KR); Jao-goo Lee, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 722 days.

(21) Appl. No.: 11/560,182

(22) Filed: Nov. 15, 2006

(65) Prior Publication Data

US 2007/0126688 A1 Jun. 7, 2007

(30) Foreign Application Priority Data

Nov. 25, 2005 (KR) ..... 10-2005-0113497

(51) Int. Cl.
*G09G 3/36* (2006.01)

(52) U.S. Cl. ..... 345/100; 345/96

(58) Field of Classification Search ..... 345/87–104
See application file for complete search history.

(56) References Cited

U.S. PATENT DOCUMENTS 6,331,846 B1 * 12/2001 Nakao ..... 345/96
6,452,526 B2 * 9/2002 Sagawa et al. ..... 341/144
6,707,442 B2 * 3/2004 Watanabe ..... 345/100
6,870,524 B2 * 3/2005 Katsutani ..... 345/98
6,977,635 B2 * 12/2005 Ogawa et al. ..... 345/93
2006/0227092 A1 * 10/2006 Nose ..... 345/98

FOREIGN PATENT DOCUMENTS

JP 2001-343948 12/2001
KR 2002-025791 4/2002
KR 2005-078269 5/2005

* cited by examiner

*Primary Examiner* — Jimmy H Nguyen
(74) *Attorney, Agent, or Firm* — F. Chau & Associates, LLC

(57) ABSTRACT

A source driver and a source line driving method capable of removing the offset effect of an amplifier for every two frames. The source driver includes an amplification unit, an input controller and an output controller. The amplification unit includes a positive amplifier outputting an output voltage having a positive deviation relative to an input voltage applied thereto and a negative amplifier outputting an output voltage having a negative deviation relative to an input voltage applied thereto. The input controller transfers a first gray-level voltage corresponding to a driving voltage of a first source line and a second gray-level voltage corresponding to a driving voltage of a second source line adjacent to the first source line to the amplification unit in response to input positive control signals or input negative control signals. The output controller applies the output voltage of the positive amplifier or the output voltage of the negative amplifier to the first or second source line in response to output positive control signals or output negative control signals.

26 Claims, 9 Drawing Sheets

SOURCE DRIVER CAPABLE OF REMOVING OFFSET IN DISPLAY DEVICE AND METHOD FOR DRIVING SOURCE LINES OF DISPLAY DEVICE

CROSS-REFERENCE TO RELATED PATENT APPLICATION

This application claims the benefit of Korean Patent Application No. 10-2005-0113497, filed on Nov. 25, 2005, in the Korean Intellectual Property Office, the disclosure of which is incorporated herein in its entirety by reference.

BACKGROUND OF THE INVENTION

1. Technical Field

The present disclosure relates to a source driver capable of removing an offset in a display device and a method for driving source lines of the display device. More particularly, the present invention relates to a source driver and a source line driving method capable of removing the offset effect of an amplifier for every two frames.

2. Discussion of the Related Art

A thin film transistor-liquid crystal display (TFT-LCD) is used in notebook computers, desktop computers, mobile terminals and portable terminals. The TFT-LCD includes a TFT-LCD panel and a driver for driving the TFT-LCD panel.

FIG. 1 is a block diagram of a conventional TFT-LCD. Referring to FIG. 1, the TFT-LCD includes a TFT-LCD panel 130, a gate driver 120 and a source driver 110 for driving the TFT-LCD panel 130.

A pixel of the TFT-LCD panel 130 is selected by a gate line GL and a source line SL. The pixel can include a liquid crystal capacitor Cc and a thin film transistor switch Tr. When a signal applied to the gate line GL turns on the thin film transistor switch Tr, a driving voltage Yd applied to the source line SL is transmitted to the liquid crystal capacitor Cc. The liquid crystal molecules of the liquid crystal capacitor Cc are aligned in response to a difference between the driving voltage Yd and a common voltage Vc. The quantity of back light transmitted through the liquid crystal is determined according to the alignment state of the liquid crystal and, thus, the TFT-LCD displays images with luminance corresponding to the driving voltage Yd.

The gate line GL is driven by a driving voltage Xd output from the gate driver 120 and the source line SL is driven by the driving voltage Yd output from the source driver 110. The source driver 110 includes a decoder DEC for converting external video data Din into a gray-level voltage Dout and an amplifier Amp for amplifying the gray-level voltage Dout output from the decoder DEC and applying the driving voltage Yd to the source line SL.

FIG. 2 illustrates the source driver 110 of FIG. 1 in more detail. Referring to FIG. 2, the source driver 110 includes a plurality of decoders DEC1, DEC2, . . . and a plurality of amplifiers Amp1, Amp2, . . . for driving a plurality of source lines. The first decoder DEC1 converts external video data Din1 into a first gray-level voltage Dout1 and the first amplifier Amp1 buffers the first gray-scale voltage Dout1 and applies a first driving voltage Yd1 to a first source line. The second decoder DEC2 converts external video data Din2 into a second gray-level voltage Dout2 and the second amplifier Amp2 buffers the second gray-scale voltage Dout2 and applies a second driving voltage Yd2 to a second source line.

There is a deviation between the output voltage and the input voltage of each of the amplifiers Amp1, Amp2, . . . , because each amplifier has an offset due to its internal characteristic. The output voltage of each amplifier, therefore, has a positive or negative deviation relative to the input voltage. Furthermore, the amplifiers Amp1, Amp2, . . . may have different respective deviations. Thus, they can have different output voltages even when the same gray-level voltage is applied thereto.

The deviations caused by offsets of the amplifiers Amp1, Amp2, . . . of the source driver 110 generate stripes on images displayed on the TFT-LCD to remarkably deteriorate the display quality of the TFT-LCD. To prevent the deterioration of the display quality of the TFT-LCD, there have been proposed various methods including U.S. Pat. No. 6,331,846, entitled "Differential amplifier, operational amplifier employing the same, and liquid crystal driving circuit incorporating the operational amplifier".

SUMMARY OF THE INVENTION

Exemplary embodiments of the present invention provide a source driver of a display device and a method for driving source lines of the display device for preventing the display quality of the display device from being deteriorated due to an offset of an amplifier included in the source driver.

According to an exemplary embodiment of the present invention, there is provided a source driver of a display device including an amplification unit, an input controller and an output controller. The amplification unit includes a positive amplifier outputting an output voltage having a positive deviation relative to an input voltage applied thereto and a negative amplifier outputting an output voltage having a negative deviation relative to an input voltage applied thereto. The input controller transfers a first gray-level voltage corresponding to a driving voltage of a first source line to the positive amplifier and transfers a second gray-level voltage corresponding to a driving voltage of a second source line adjacent to the first source line to the negative amplifier in response to input positive control signals. The input controller transfers the first gray-level voltage to the negative amplifier and transfers the second gray-level voltage to the positive amplifier in response to input negative control signals. The output controller applies the output voltage of the positive amplifier to the first source line and applies the output voltage of the negative amplifier to the second source line in response to output positive control signals. The output controller applies the output voltage of the negative amplifier to the first source line and applies the output voltage of the positive amplifier to the second source line in response to output negative control signals.

According to an exemplary embodiment of the present invention, there is provided a source driver of a display device including a conversion unit, an amplification unit and a controller. The conversion unit receives external video data, decodes the received external video data to output a first gray-level voltage corresponding to a driving voltage of a first source line, and decodes the received external video data to output a second gray-level voltage corresponding to a driving voltage of a second source line adjacent to the first source line. The amplification unit includes a positive amplifier outputting an output voltage having a positive deviation against an input voltage applied thereto and a negative amplifier outputting an output voltage having a negative deviation against an input voltage applied thereto. The controller controls the input and output of the amplification unit. The controller transfers the first gray-level voltage to the positive offset amplifier, applies the output voltage of the positive amplifier to the first source line, transfers the second gray-level voltage to the negative amplifier and applies the output voltage of the negative amplifier to the second source line when receiving positive control signals. The controller transfers the first gray-level voltage to the negative offset amplifier, applies the output voltage of the negative amplifier to the first source line, transfers the second gray-level voltage to the positive amplifier and applies the output voltage of the positive amplifier to the second source line when receiving negative control signals.

According to an exemplary embodiment of the present invention, there is provided a method for driving source lines of a display device using a source driver including a positive amplifier outputting an output voltage having a positive deviation relative to an input voltage applied thereto and a negative amplifier outputting an output voltage having a negative deviation relative to an input voltage applied thereto, comprising: (a) transferring a first gray-level voltage corresponding to a driving voltage of a first source line to the positive offset amplifier, applying the output voltage of the positive amplifier to the first source line, transferring a second gray-level voltage corresponding to a driving voltage of a second source line adjacent to the first source line to the negative offset amplifier, and applying the output voltage of the negative amplifier to the second source line; and (b) transferring the first gray-level voltage to the negative offset amplifier, applying the output voltage of the negative amplifier to the first source line, transferring the second gray-level voltage to the positive offset amplifier, applying the output voltage of the positive amplifier to the second source line.

The positive control signals (the input positive control signals and the output positive control signals) are input to the controller (the input controller and the output controller) for the Nth frame of the display device, and the negative control signals (the input negative control signals and the output negative control signals) are input to the controller (the input controller and the output controller) for the (N+1)th frame of the display device.

The controller (the input controller and the output controller) removes a display error in the pixels connected to the first source line or in the pixels connected to the second source line, caused by the positive deviation or the negative deviation, for every two frames.

The first source line is an arbitrary source line included in the display panel of the display device, and the second source line is a source line adjacent to the first source line.

The input controller includes a first input positive switch transferring the first gray-level voltage to the positive amplifier in response to the input positive control signals, a second input positive switch transferring the second gray-level voltage to the negative amplifier in response to the input positive control signals, a first input negative switch transferring the first gray-level voltage to the negative amplifier in response to the input negative control signals, and a second input negative switch transferring the second gray-level voltage to the positive amplifier in response to the input negative control signals.

The output controller includes a first output positive switch applying the output voltage of the positive amplifier to the first source line in response to the output positive control signals, a second output positive switch applying the output voltage of the negative amplifier to the second source line in response to the output positive control signals, a first output negative switch applying the output voltage of the positive amplifier to the second source line in response to the output negative control signals, and a second output negative switch applying the output voltage of the negative amplifier to the first source line in response to the output negative control signals.

When the operation of the source driver is tested through a pad connected to the first source line, the output characteristic of the positive amplifier may be tested by turning on the first output positive switch or the output characteristic of the negative amplifier may be tested by turning on the second output negative switch.

When the operation of the source driver is tested through a pad connected to the second source line, the output characteristic of the positive amplifier may be tested by turning on the first output negative switch or the output characteristic of the negative amplifier may be tested by turning on the second output positive switch.

BRIEF DESCRIPTION OF THE DRAWINGS

Exemplary embodiments of the present invention will be understood in more detail from the following descriptions taken in conjunction with the attached drawings in which.

DETAILED DESCRIPTION OF EXEMPLARY EMBODIMENTS

Figure 1:
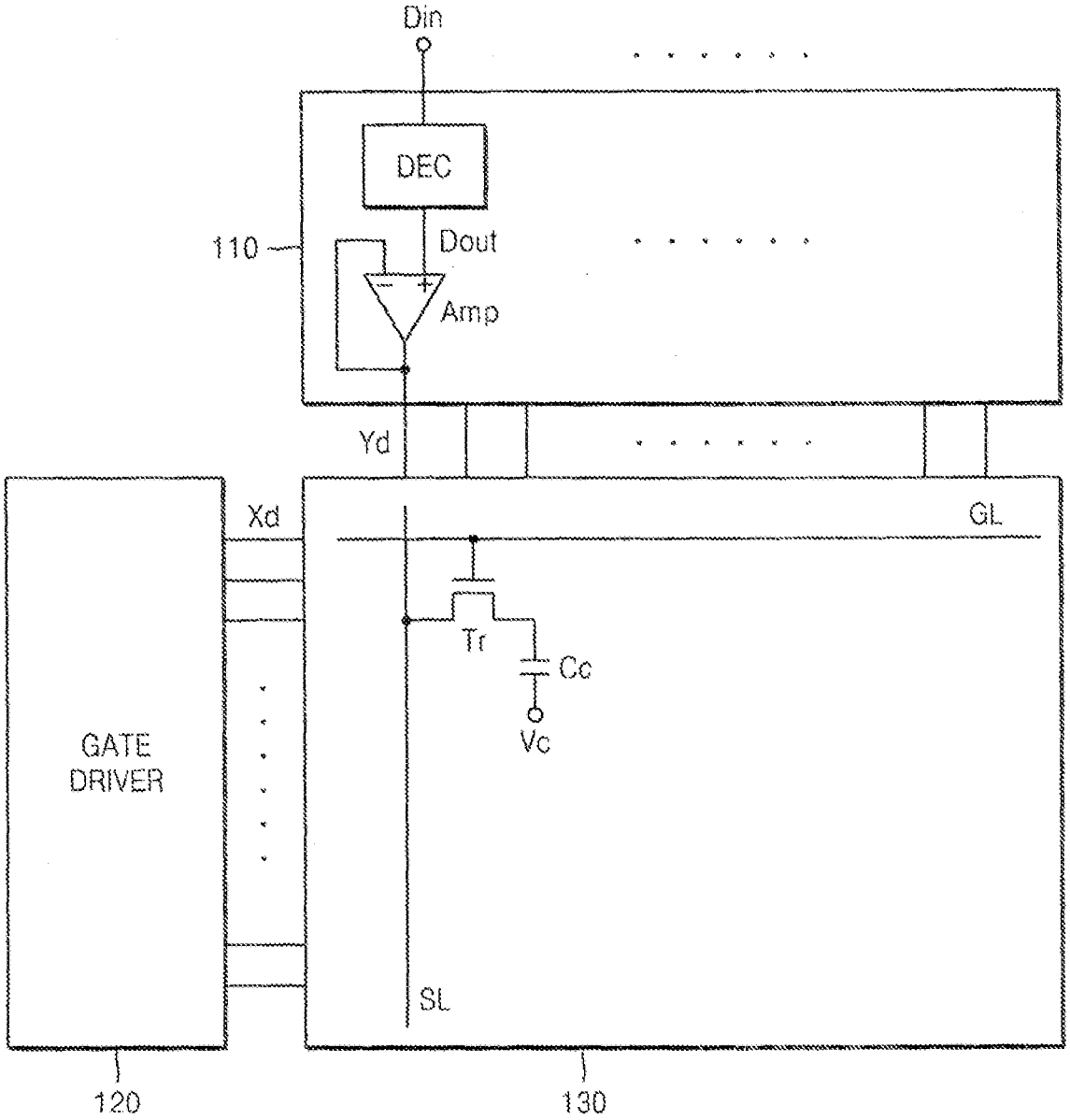
FIG. 1 (PRIOR ART)
FIG. 1 is a block diagram of a conventional TFT-LCD.
Figure 2:
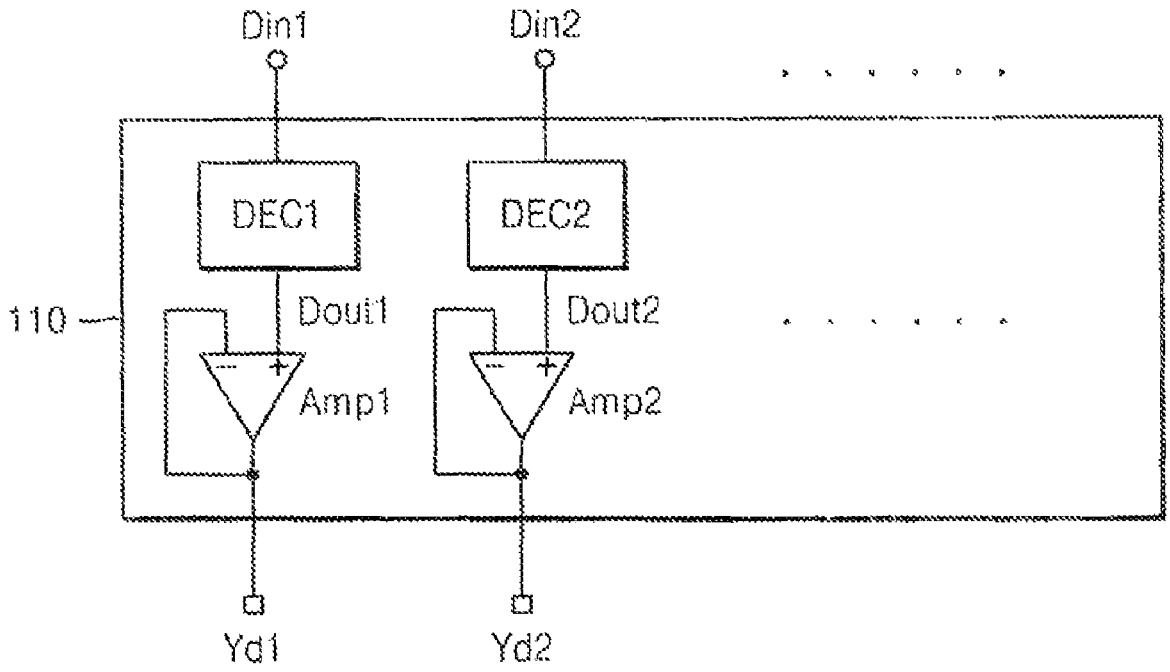
FIG. 2 (PRIOR ART)
FIG. 2 illustrates a source driver of FIG. 1 in detail.

Exemplary embodiments of the present invention will now be described more fully with reference to the accompanying drawings, in which exemplary embodiments of the invention are shown. The invention may, however, be embodied in many different forms and should not be construed as being limited to the exemplary embodiments set forth herein; rather, these exemplary embodiments are provided so that this disclosure will be thorough and complete, and will fully convey the concept of the invention to those skilled in the art. Throughout the drawings, like reference numerals refer to like elements.

A method of removing the offset effect of an amplifier for every two frames is explained first.

Figure 3A:
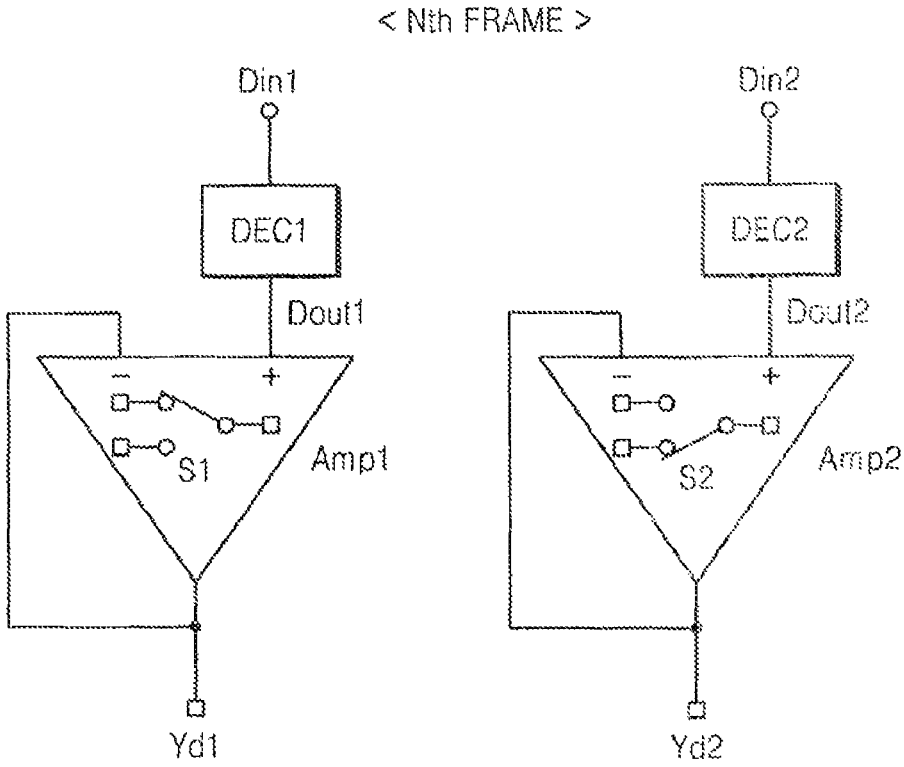
FIGS. 3A and 3B are diagrams for explaining the operation of a source driver for the Nth frame when the offset effect of an amplifier is removed for every two frames.
Figure 3B:
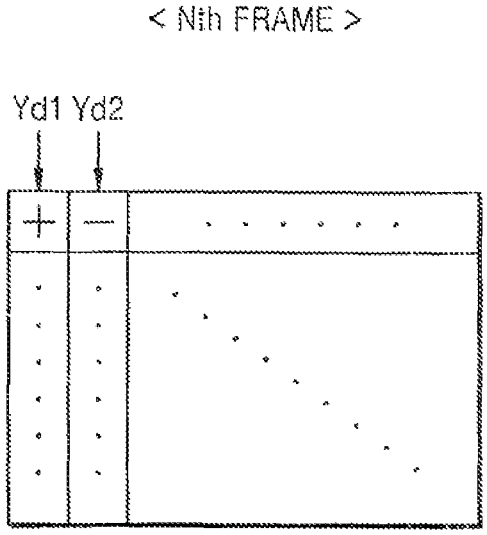
Figure 4A:
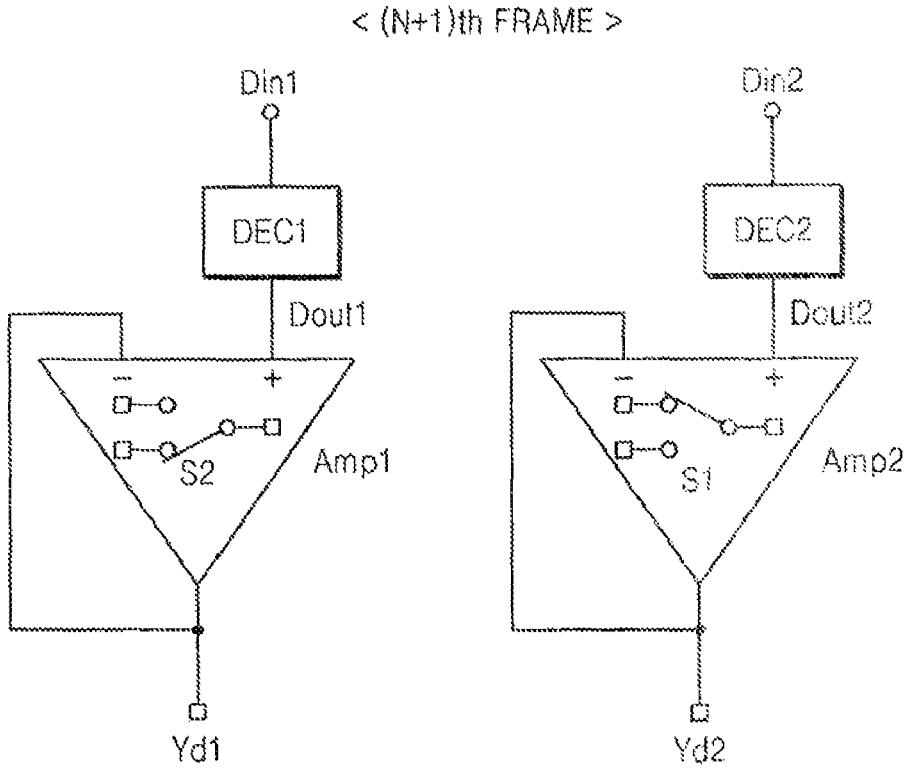
FIGS. 4A and 4B are diagrams for explaining the operation of the source driver for the (N+1)th frame when the offset effect of the amplifier is removed for every two frames.
Figure 4B:
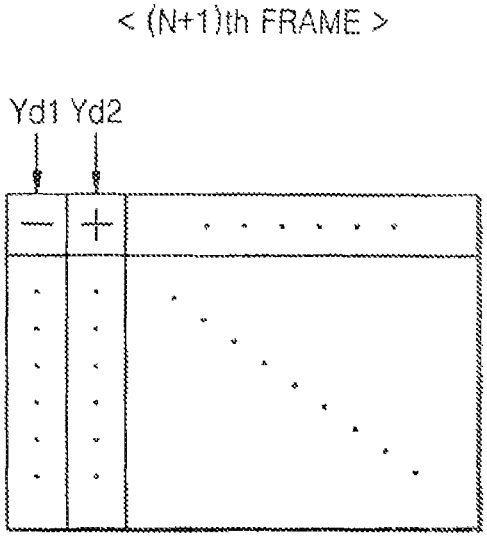

FIGS. 3A and 3B are diagrams for explaining the operation of a source driver for the Nth frame when the offset effect of an amplifier is removed for every two frames, and FIGS. 4A and 4B are diagrams for explaining the operation of the source driver for the (N+1)th frame, when the offset effect of the amplifier is removed for every two frames. As shown in FIGS. 3A and 4A, an amplifier Amp1 or Amp2 of the source driver (corresponding to the source driver 110 of FIG. 1) includes a switching element such as a MOSFET. While FIGS. 3A and 4A show a single switching element, it does not mean that the amplifier Amp1 or Amp2 includes only a single switching element. The switching element shown in FIGS. 3A and 4A represents a plurality of switching elements included in the amplifier.

The operation state of the amplifier Amp1 or Amp2 can be divided into a state S1 and a state S2 according to the connection state of the switching elements forming a predetermined signal transmission path in the amplifier Amp1 or Amp2. In the state S1, the switching elements are connected such that the amplifier Amp1 or Amp2 has a positive deviation. When the amplifier Amp1 or Amp2 has the positive deviation, the output voltage of the amplifier Amp1 or Amp2 is higher than the input voltage of the amplifier Amp1 or Amp2 by the amount of the deviation.

In the state S2, the switching elements are connected such that the amplifier Amp1 or Amp2 has a negative deviation. When the amplifier Amp1 or Amp2 has the negative deviation, the output voltage of the amplifier Amp1 or Amp2 is lower than the input voltage of the amplifier Amp1 or Amp2 by the amount of the deviation. Referring to FIG. 3A, the first amplifier Amp1 is in the state S1 in the Nth frame.

A first decoder DEC1 converts external video data Din1 into a first gray-level voltage Dout1, and the first amplifier Amp1 buffers the first gray-level voltage Dout1 and applies a first driving voltage Yd1 to a first source line. Because the first amplifier Amp1 is in the state S1, the first driving voltage Yd1 applied to the first source line is higher than the first gray-level voltage Dout1 applied to the first amplifier Amp1 by a deviation caused by the offset of the first amplifier Amp1. Accordingly, the brightness of pixels connected to the first source line is increased by the amount of the deviation when the first driving voltage Yd1 is applied to the first source line compared to when the first gray-level voltage Dout1 is applied to the first source line.

FIG. 3B shows the pixels having the brightness increased by the deviation caused by the offset of the first amplifier. In FIG. 3B, these pixels are applied with Yd1 and correspond to "+".

Referring to FIG. 3A, the second amplifier Amp2 is in the state S2 for the Nth frame. A second decoder DEC2 converts external video data Dint into a second gray-level voltage Dout2, and the second amplifier Amp1 buffers the second gray-level voltage Dout2 and applies a second driving voltage Yd2 to a second source line. Because the second amplifier Amp2 is in the state S2, the second driving voltage Yd1 applied to the second source line is lower than the second gray-level voltage Dout2 applied to the second amplifier Amp2 by a deviation caused by the offset of the second amplifier Amp2. Accordingly, the brightness of pixels connected to the second source line is decreased by the amount of the deviation when the second driving voltage Yd2 is applied to the second source line compared to when the second gray-level voltage Dout2 is applied to the second source line.

FIG. 3B shows the pixels having the brightness decreased by the deviation caused by the offset of the second amplifier. In FIG. 3B, these pixels are applied with Yd2 and correspond to "−".

Referring to FIG. 4A, the first amplifier Amp1 is in the state S2 for the (N+1)th frame. Thus, the first driving voltage Yd1 applied to the first source line is lower than the first gray-level voltage Dout1 applied to the first amplifier Amp1 by an amount of the deviation caused by the offset of the first amplifier Amp1. Accordingly, the brightness of pixels connected to the first source line is decreased by the amount of the deviation when the first driving voltage Yd1 is applied to the first source line compared to when the first gray-level voltage Dout1 is applied to the first source line.

FIG. 4B shows the pixels having the brightness decreased by the amount of the deviation caused by the offset of the first amplifier. In FIG. 4B, these pixels are applied with Yd1 and correspond to "−".

Referring to FIG. 4A, the second amplifier Amp2 is in the state S1 for the (N+1)th frame. Thus, the second driving voltage Yd2 applied to the second source line is higher than the second gray-level voltage Dout2 applied to the second amplifier Amp2 by an amount of the deviation caused by the offset of the second amplifier Amp2. Accordingly, the brightness of pixels connected to the first source line is increased by the amount of the deviation when the second driving voltage Yd2 is applied to the second source line compared to when the second gray-level voltage Dout2 is applied to the second source line.

FIG. 4B also shows the pixels having the brightness increased by the amount of the deviation caused by the offset of the second amplifier. In FIG. 4B, these pixels are applied with Yd2 and correspond to "+".

As described above, when the first amplifier Amp1 is set to the state S1 for the Nth frame and to the state S2 for the (N+1)th frame, the brightness of pixels applied with the first driving voltage Yd1 is increased by the amount of the deviation caused by the offset of the first amplifier in the Nth frame and decreased by the amount of the deviation in the (N+1)th frame. Consequently, the effect of the positive deviation and the effect of the negative deviation are averaged and removed for the two frames.

Similarly, when the second amplifier Amp2 is set to the state S2 for the Nth frame and to the state S1 for the (N+1)th frame, the brightness of pixels applied with the second driving voltage Yd2 is decreased by the amount of the deviation caused by the offset of the second amplifier in the Nth frame and increased by the amount of the deviation in the (N+1)th frame. Consequently, the effect of the negative deviation and the effect of the positive deviation are averaged and removed for the two frames.

To operate the amplifier Amp1 or Amp2 between the states S1 and S2, however, a plurality of switching elements included in the amplifier Amp1 or Amp2 should continuously perform switching operations for each frame.

Exemplary embodiments of the present invention provide a method that does not require continuous switching of the plurality of switching elements of the amplifier for each frame.

Figure 5:
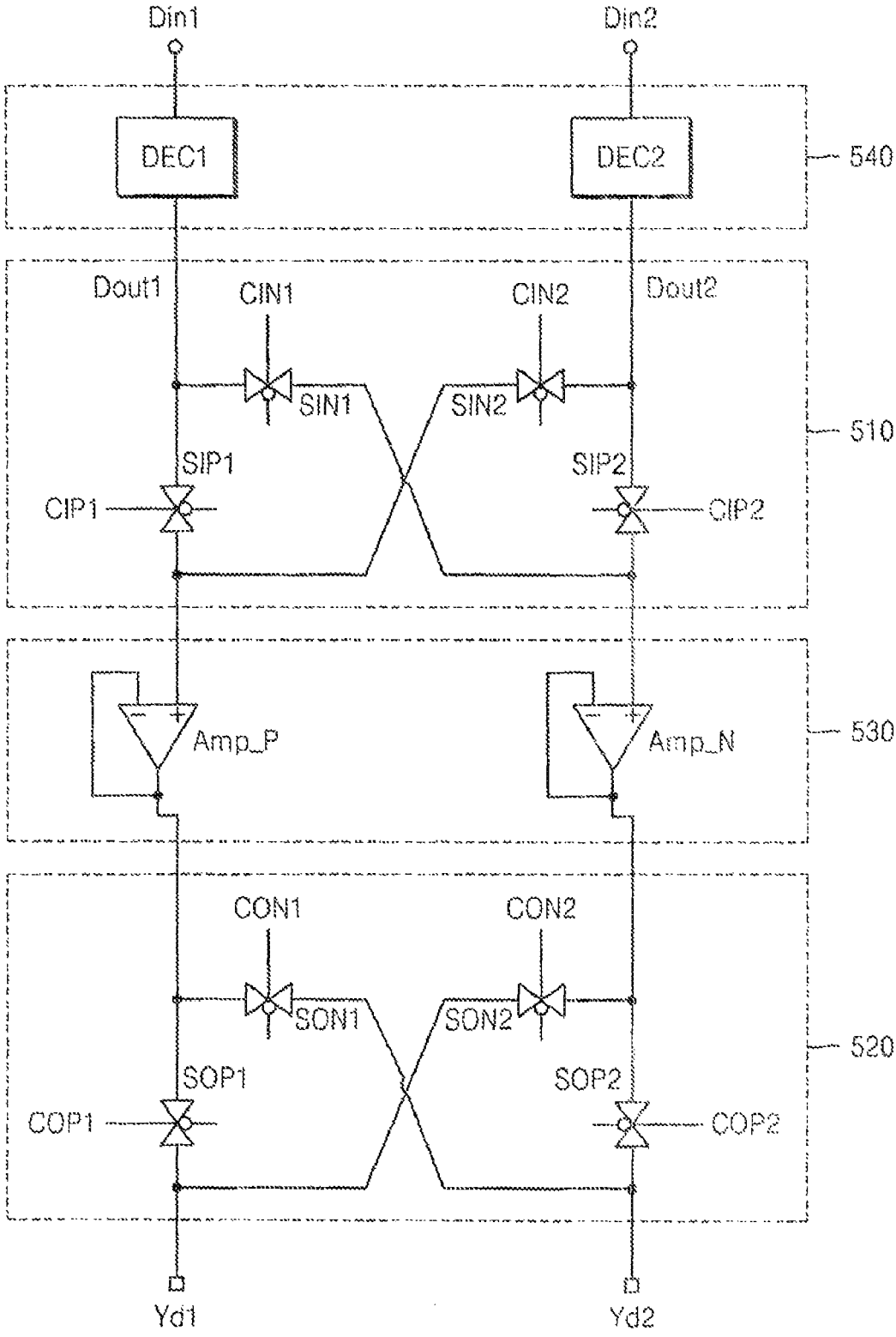
FIG. 5 is a block diagram of a source driver according to an exemplary embodiment of the present invention.

FIG. 5 is a block diagram of a source driver according to an exemplary embodiment of the present invention. Referring to FIG. 5, the source driver includes controllers, an amplification unit 530 and a conversion unit 540. The controllers include an input controller 510 and an output controller 520. The amplification unit 530 includes a positive amplifier Amp_P and a negative amplifier Amp_N, and the conversion unit 540 includes a first decoder DEC1 and a second decoder DEC2.

The input controller 510 includes a first input positive switch SIP1, a second input positive switch SIP2, a first input switch SIN1 and a second input switch SIN2. The output controller 520 includes a first output positive switch SOP1, a second output positive switch SOP2, a first output switch SON1 and a second output switch SON2.

The first decoder DEC1 receives external video data Dint and outputs a first gray-level voltage Dout1 to the input controller 510. The second decoder DEC2 receives external video data Din2 and outputs a second gray-scale voltage Dout2 to the input controller 510. The conversion unit 540 includes the first and second decoders DEC1 and DEC2 functions as a digital-analog converter that decodes digital data (external video data Dint and Din2) to convert the digital data into analog voltages (the first and second gray-level voltages Dout1 and Dout2).

The first decoder DEC1 outputting the first gray-level voltage Dout1 is a component involved in driving a first source line and the second decoder DEC2 outputting the second gray-level voltage Dout2 is a component involved in driving a second source line. Here, the first source line means an arbitrary source line included in a TFT-LCD panel and the second source line means a source line adjacent to the first source line. A first driving voltage Yd1 is applied to the first source line and a second driving voltage Yd2 is applied to the second source line.

The positive amplifier Amp_P outputs a voltage having a positive deviation against the voltage input thereto and the negative amplifier Amp_N outputs a voltage having a negative deviation against the voltage input thereto. That is, the positive amplifier Amp_P outputs a voltage higher than the input voltage by an amount of the deviation caused by the offset thereof and the negative amplifier Amp_N outputs a voltage higher than the input voltage by an amount of the deviation caused by the offset thereof. As shown in FIG. 5, the positive amplifier Amp_P and the negative amplifier Amp_N are operational amplifiers and function as buffers.

The controllers 510 and 520 control the input and output, respectively, of the amplification unit 530. The controllers 510 and 520 transfer the first gray-level voltage Dout1 to the positive amplifier Amp_P, apply the output voltage of the positive amplifier Amp_P to the first source line, transfer the second gray-level voltage Dout2 to the negative amplifier Amp_N, and apply the output voltage of the negative amplifier Amp_N to the second source line, when receiving positive control signals CIP1, CIP2, COPT and COP2.

The controllers 510 and 520 transfer the first gray-level voltage Dout1 to the negative amplifier Amp_N, apply the output voltage of the negative amplifier Amp_N to the first source line, transfer the second gray-level voltage Dout2 to the positive amplifier Amp_P, and apply the output voltage of the positive amplifier Amp_P to the second source line, when receiving negative control signals CIN1, CIN2, CON1 and CON2.

The operation of the controllers 510 and 520 will now be described in more detail.

The input controller 510 turns on the first input positive switch SIP1 to transfer the first gray-level voltage Dout1 to the positive amplifier Amp_P and turns on the second input positive switch SIP2 to transfer the second gray-level voltage Dout2 to the negative amplifier Amp_N when receiving the positive control signals CIP1 and CIP2. The input controller 510 turns on the first input negative switch SIN1 to transfer the first gray-level voltage Dout1 to the negative amplifier Amp_N and turns on the second input negative switch SIN2 to transfer the second gray-level voltage Dout2 to the positive amplifier Amp_P when receiving the negative control signals CIN1 and CIN2.

The output controller 520 turns on the first output positive switch SOP1 to transfer the output voltage of the positive amplifier Amp_P to the first source line and turns on the second output positive switch SOP2 to transfer the output voltage of the negative amplifier Amp_N to the second source line when receiving the positive control signals COP1 and COP2. The output controller 520 turns on the first output negative switch SON1 to transfer the output voltage of the positive amplifier Amp_P to the second source line and turns on the second output negative switch SON2 to transfer the output voltage of the negative amplifier Amp_N to the first source line when receiving the negative control signals CON1 and CON2.

Transfer gates each having an N-type MOSFET and a P-type MOSFET or MOSFET switches can be used as the first and second input positive switches SIP1 and SIP2, the first and second output positive switches SOP1 and SOP2, the first and second input negative switches SIN1 and SIN2, the first and second output negative switches SON1 and SON2.

The operation of the source driver according to an exemplary embodiment of the present invention will now be explained with reference to FIGS. 6A and 6B.

Figure 6A:
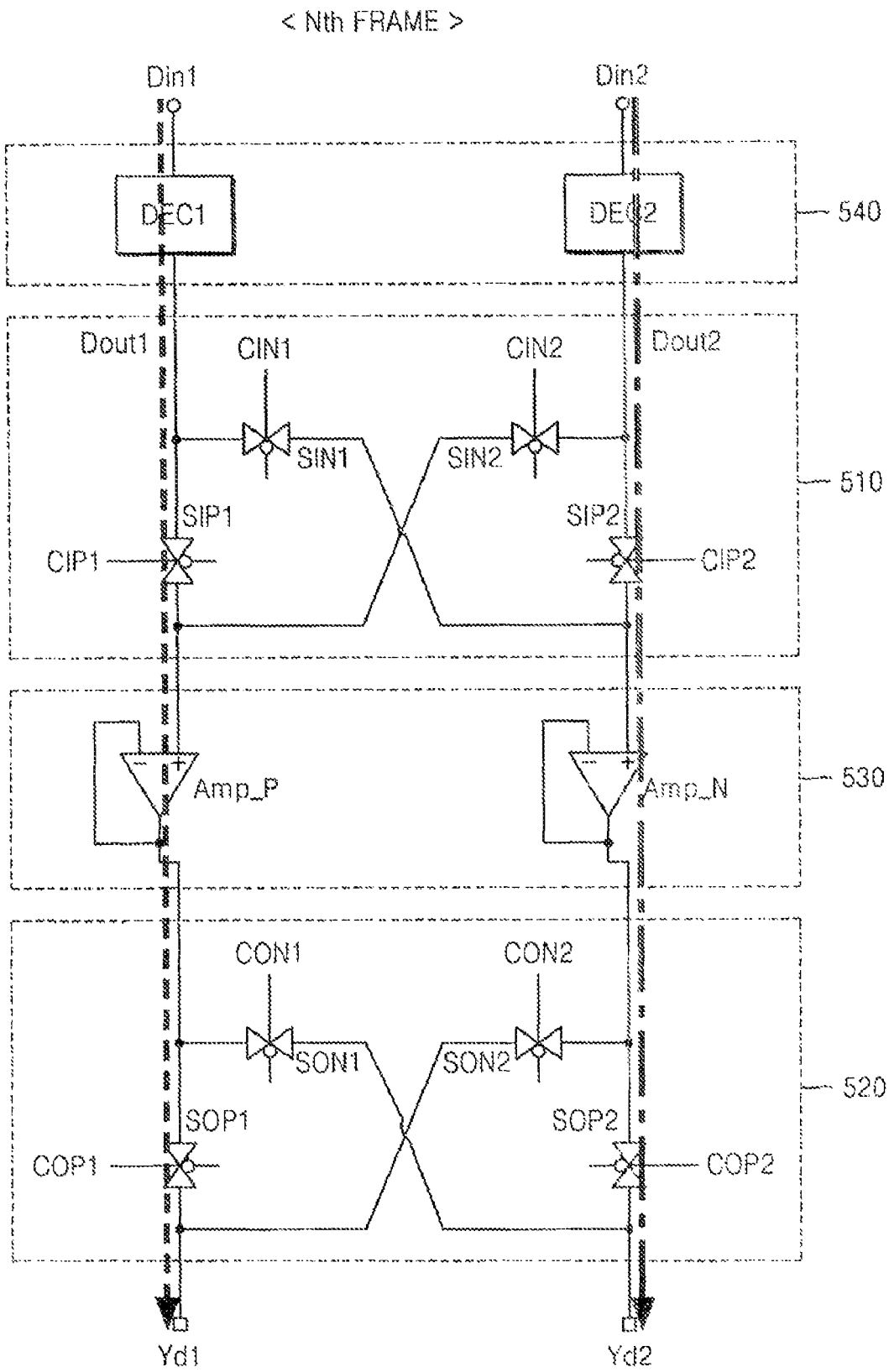
FIG. 6A illustrates the operation of the source driver according to an exemplary embodiment of the present invention for the Nth frame.
Figure 6B:
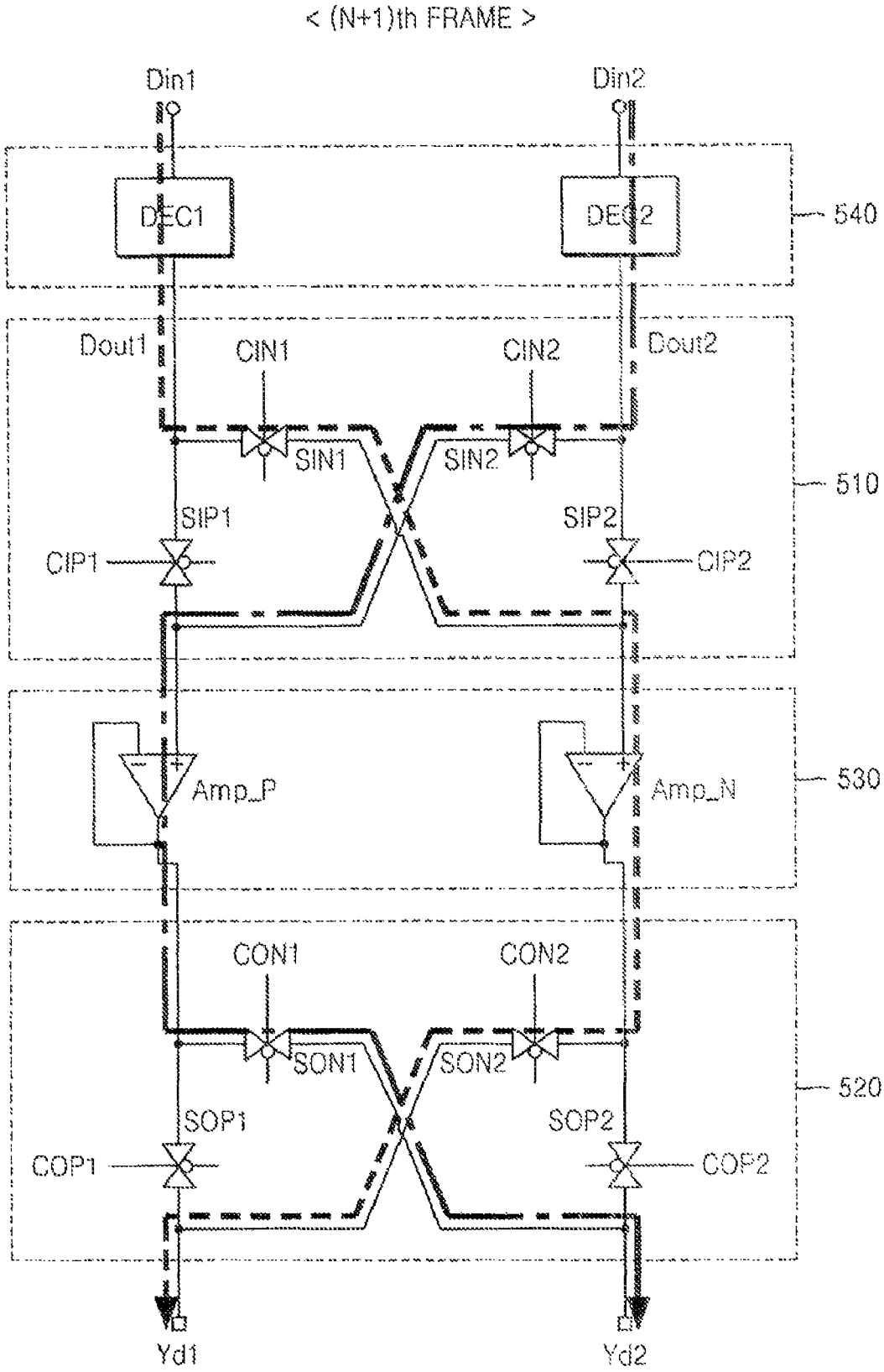
FIG. 6B illustrates the operation of the source driver according to an exemplary embodiment of the present invention for the (N+1)th frame.

FIG. 6A illustrates the operation of the source driver for the Nth frame, and FIG. 6B illustrates the operation of the source driver for the (N+1)th frame, according to an exemplary embodiment of the present invention.

Referring to FIG. 6A, the positive control signals CIP1, CIP2, COP1 and COP2 are input to the controllers 510 and 520 for the Nth frame. Specifically, the positive control signals CIP1 and CIP2 are input to the input controller 510 and the positive control signals COP1 and COP2 are input to the output controller 520. Then, the external video data Din1 is converted into the first gray-level voltage Dout1 by the first decoder DEC1 and transferred to the positive amplifier Amp_P through the first input positive switch SIP1. The output voltage of the positive amplifier Amp_P is applied to the first source line through the first output positive switch SOP1. The external video data Dint is converted into the second gray-level voltage Dout2 by the second decoder DEC2 and transferred to the negative amplifier Amp_N through the second input positive switch SIP2. The output voltage of the negative amplifier Amp_N is applied to the second source line through the second output positive switch SOP2.

Referring to FIG. 6B, the negative control signals CIN1, CIN2, CON1 and CON2 are input to the controllers 510 and 520 for the (N+1)th frame. Specifically, the negative control signals CIN1 and CIN2 are input to the input controller 510 and the negative control signals CON1 and CON2 are input to the output controller 520. Then, the external video data Din1 is converted into the first gray-level voltage Dout1 by the first decoder DEC1 and transferred to the negative amplifier Amp_N through the first input negative switch SIN1. The output voltage of the negative amplifier Amp_N is applied to the first source line through the second output negative switch SON2. The external video data Din2 is converted into the second gray-level voltage Dout2 by the second decoder DEC2 and transferred to the positive amplifier Amp_P through the second input negative switch SIN2. The output voltage of the positive amplifier Amp_P is applied to the second source line through the first output negative switch SON1.

When the source driver of FIG. 5 is operated as shown in FIG. 6A for the Nth frame and operated as shown in FIG. 6B for the (N+1)th frame, the first source line is provided with a voltage higher than the first gray-level voltage Dout1 by an amount of the deviation caused by the offset of the corresponding amplifier in the Nth frame and a voltage lower than the first gray-level voltage Dout1 by an amount of the deviation caused by the offset of the corresponding amplifier in the (N+1)th frame. Similarly, the second source line is provided with a voltage lower than the second gray-level voltage Dout2 by an amount of the deviation caused by the offset of the corresponding amplifier in the Nth frame and a voltage higher than the second gray-level voltage Dout2 by an amount of the deviation caused by the offset of the corresponding amplifier in the (N+1)th frame.

Accordingly, the brightness of pixels connected to the first source line is increased by the amount of the deviation in the Nth frame and decreased by the amount of the deviation in the (N+1)th frame. The brightness of pixels connected to the second source line is decreased by the amount of the deviation in the Nth frame and increased by the amount of the deviation in the (N+1)th frame. Consequently, the effect of the positive deviation and the effect of the negative deviation are averaged and removed for every two frames.

To remove the effect of the deviation caused by the offset of the amplifiers for every two frames, the positive control signals CIP1, CIP2, COP1 and COP2 and the negative control signals CIN1, CIN2, CON1 and CON2 should be alternately input to the input and output controllers 510 and 520 for respective frames. That is, the first input positive switch SIP1 and the first input negative switch SIN1 should be alternately turned on, and the second input positive switch SIP2 and the second input negative switch SIN2 should be alternately turned on for the respective frames. In addition, the first output positive switch SOP1 and the first output negative switch SON1 should be alternately turned on, and the second output positive switch SOP2 and the second output negative switch SON2 should be alternately turned on for the respective frames.

Distinguished from the conventional source driver that controls opening and closing of the plurality of switching elements included in the amplifier AmP1 or Amp2 for each frame, as shown in FIGS. 3A and 4A, exemplary embodiments of the present invention control opening and closing of the switches included in the controllers 510 and 520 separated from the amplifiers Amp_P and Amp_N. Accordingly, internal current paths of the amplifiers Amp_P and Amp_N are not changed discontinuously.

The controllers 510 and 520 of the source driver according to exemplary embodiments of the present invention require only four switch pairs SIP1 and SIN1, SIP2 and SIN2, SOP1 and SON1, and SOP2 and SON2. Accordingly, the number of switches for constituting the source driver can be reduced compared to the conventional source driver having a plurality of switches in the amplifiers.

A method for driving source lines of a display device according to an exemplary embodiment of the present invention, which can remove the effect of deviation caused by the offset of amplifiers for every two frames, will now be explained.

In the first step, the first gray-level voltage Dout1 corresponding to the driving voltage Yd1 of the first source line is transferred to the positive amplifier Amp_P and the output voltage of the positive amplifier Amp_P is applied to the first source line. The second gray-level voltage Dout2 corresponding to the driving voltage Yd2 of the second source line adjacent to the first source line is transferred to the negative amplifier Amp_N and the output voltage of the negative amplifier Amp_N is applied to the second source line.

In the second step, the first gray-level voltage Dout1 is transferred to the negative amplifier Amp_N and the output voltage of the negative amplifier Amp_N is applied to the first source line. The second gray-level voltage Dout2 is transferred to the positive amplifier Amp_P and the output voltage of the positive amplifier Amp_P is applied to the second source line.

The first step is executed for the Nth frame and the second step is performed for the (N+1)th frame. That is, the first step corresponds to the operation shown in FIG. 6A and the second step corresponds to the operation shown in FIG. 6B.

According to the above-described source line driving method, the effect of deviation caused by the offset of amplifiers can be removed for every two frames.

Figure 7A:
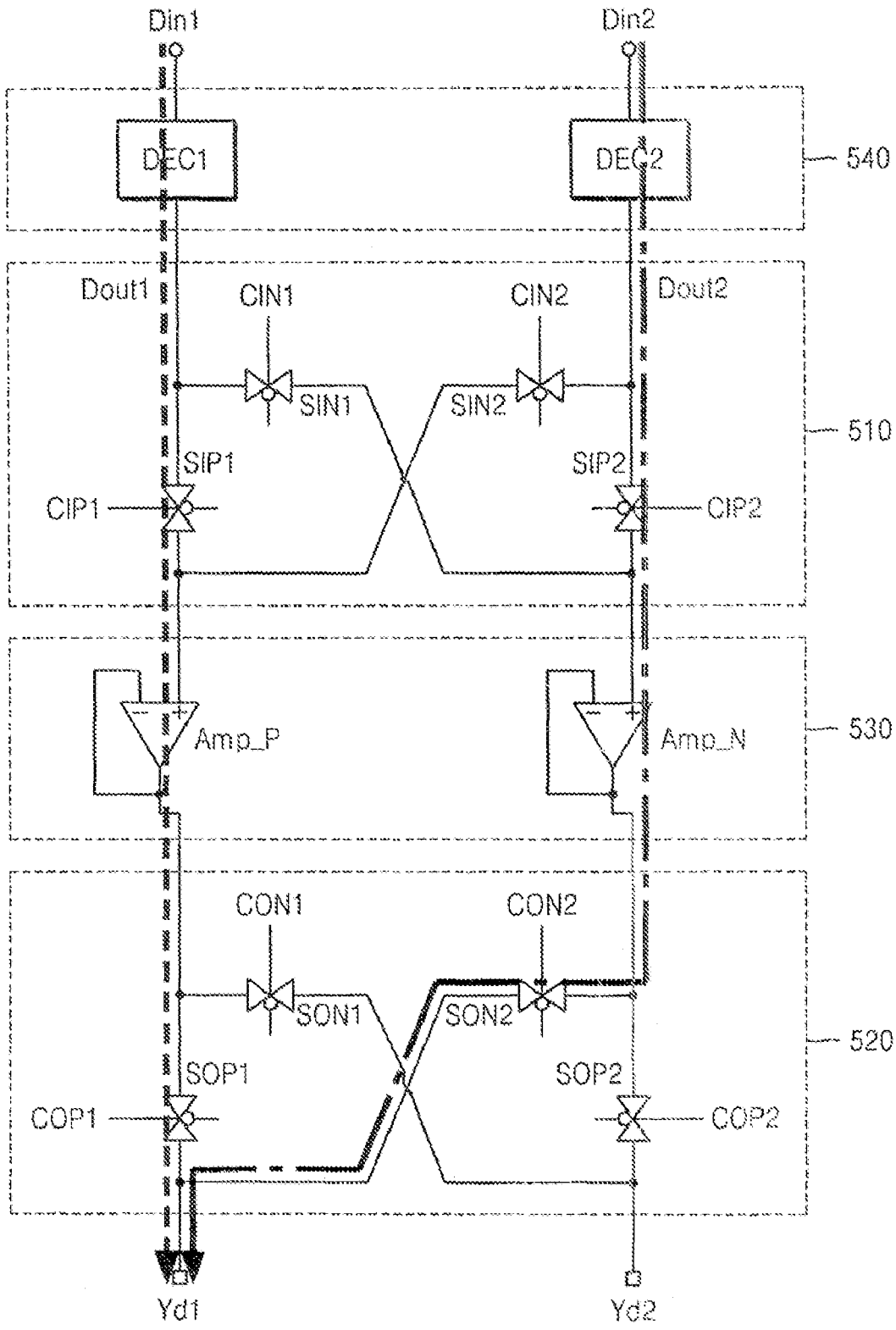
FIGS. 7A and 7B illustrate the operation of the source driver according to an exemplary embodiment of the present invention in a test mode.
Figure 7B:
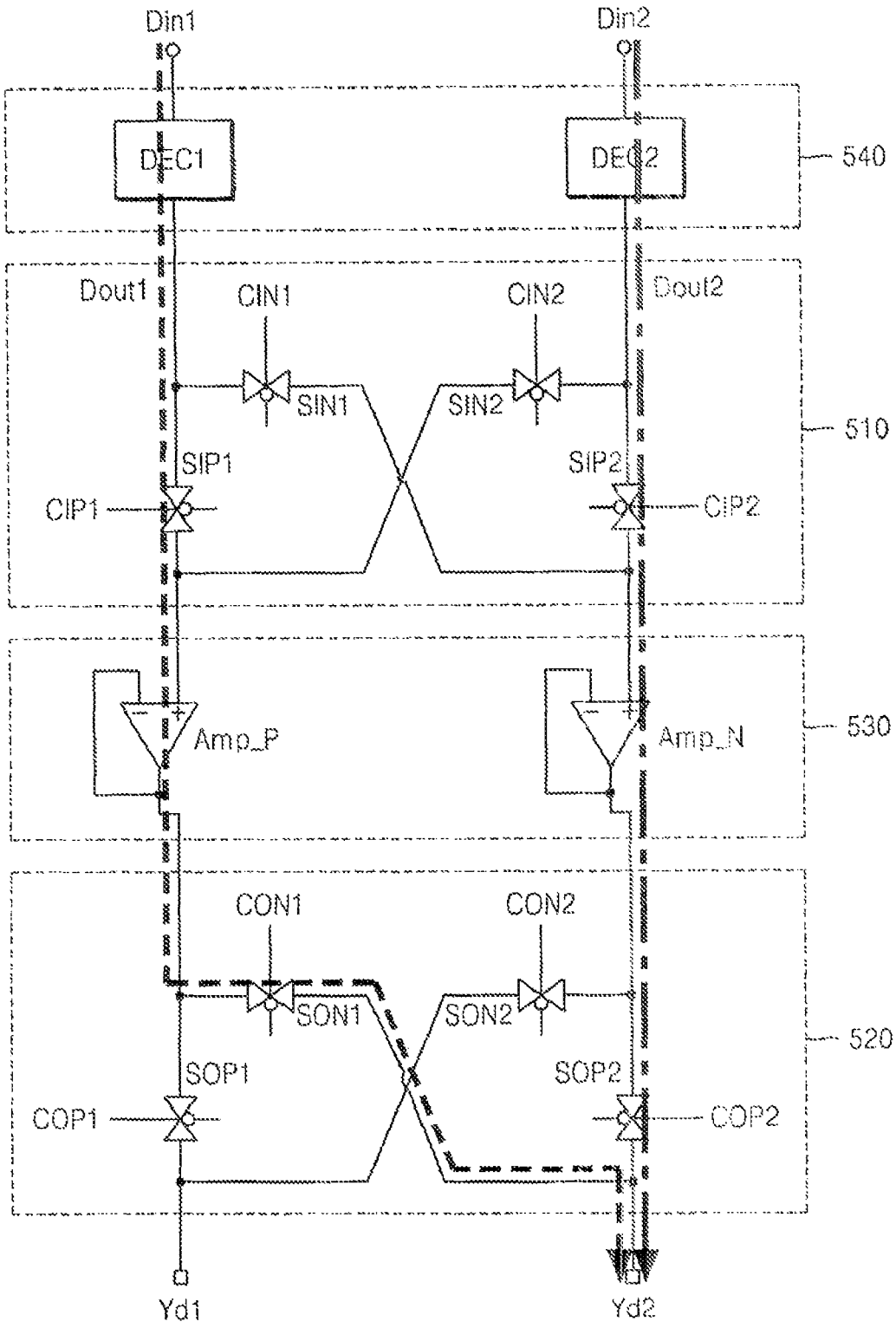

FIGS. 7A and 7B illustrate the operation of the source driver according to the present invention in a test mode. FIG. 7A shows the case of testing the operation of the source driver through a pad connected to the first source line. The output characteristic of a transmission path passing through the first decoder DEC1 and the positive amplifier Amp_P is tested by turning on the first input positive switch SIP1 and the first output positive switch SOP1, or the output characteristic of a transmission path passing through the second decoder DEC2 and the negative amplifier Amp_N is tested by turning on the second input positive switch SIP2 and the second output positive switch SON2.

FIG. 7B shows the case of testing the operation of the source driver through a pad connected to the second source line. The output characteristic of the transmission path passing through the first decoder DEC1 and the positive amplifier Amp_P is tested by turning on the first input positive switch SIP1 and the first output negative switch SON1, or the output characteristic of a transmission path passing through the second decoder DEC2 and the negative amplifier Amp_N is tested by turning on the second input positive switch SIP2 and the second output positive switch SON2.

In addition to the aforementioned method of testing the operation of the source driver by turning on the second output negative switch SON2 or the first output negative switch SON1, shown in FIGS. 7A and 7B, a method of turning on the second input negative switch SIN2 or the first input negative switch SIN1 can be used to test the operation of the source driver.

As described above, when the source driver according to an exemplary embodiment of the present invention is tested, the number of pads required for testing the operation of the source driver can be reduced.

While the source driver of the TFT-LCD has been described above, the source driver according to exemplary embodiments of the present invention is not limited to the TFT-LCD and it can be used in other kinds of displays.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A source driver of a display device comprising:

an amplification unit including a positive amplifier outputting an output voltage having a positive deviation relative to an input voltage applied thereto and a negative amplifier outputting an output voltage having a negative deviation relative to an input voltage applied thereto;

an input controller, coupled between the amplification unit and a conversion unit that functions as digital-analog converter, for transferring a first gray-level voltage corresponding to a driving voltage of a first source line to the positive amplifier and for transferring a second gray-level voltage corresponding to a driving voltage of a second source line adjacent to the first source line to the negative amplifier in response to input positive control signals fed thereto, the input controller transferring the first gray-level voltage to the negative amplifier and transferring the second gray-level voltage to the positive amplifier in response to input negative control signals fed thereto; and an output controller applying the output voltage of the positive amplifier to the first source line and applying the output voltage of the negative amplifier to the second source line in response to output positive control signals fed thereto, the output controller applying the output voltage of the negative amplifier to the first source line and applying the output voltage of the positive amplifier to the second source line in response to output negative control signals fed thereto, wherein the input controller and the output controller remove a display error in pixels connected to the first source line or in pixels connected to the second source line, caused by the positive deviation or the negative deviation, by opening and closing switching elements outside the amplification unit and alternating at consecutive frames the positive deviation and negative deviation applied to the respective first source line and second source line, and wherein the first gray-level voltage is output to the input controller from a first decoder that is involved in driving the first source line and that receives external video data, and the second gray-level voltage is output to the input controller from a second decoder that is different from the first decoder, that is involved in driving the second source line, and that receives external video data.

2. The source driver of claim 1, wherein the input positive control signals and the output positive control signals are respectively input to the input controller and the output controller for the Nth frame of the display device, and the input negative control signals and the output negative control signals are respectively input to the input controller and the output controller for the (N+1)th frame of the display device.

3. The source driver of claim 1, wherein the first source line is a selected source line included in the display panel of the display device and the second source line is a source line adjacent to the first source line.

4. The source driver of claim 1, wherein the input controller comprises:

a first input positive switch transferring the first gray-level voltage to the positive amplifier in response to the input positive control signals;

a second input positive switch transferring the second gray-level voltage to the negative amplifier in response to the input positive control signals;

a first input negative switch transferring the first gray-level voltage to the negative amplifier in response to the input negative control signals; and a second input negative switch transferring the second gray-level voltage to the positive amplifier in response to the input negative control signals.

5. The source driver of claim 4, wherein the first input positive switch and the first input negative switch are alternately turned on for respective frames, and the second input positive switch and the second input negative switch are alternately turned on for the respective frames.

6. The source driver of claim 4, wherein the first input positive switch, the second input positive switch, the first input negative switch, the second input negative switch, the first output positive switch, the second output positive switch, the first output negative switch and the second output negative switch are MOSFETs or transfer gates each having an N-type MOSFET and a P-type MOSFET.

7. The source driver of claim 1, wherein the output controller comprises:

a first output positive switch applying the output voltage of the positive amplifier to the first source line in response to the output positive control signals;

a second output positive switch applying the output voltage of the negative amplifier to the second source line in response to the output positive control signals;

a first output negative switch applying the output voltage of the positive amplifier to the second source line in response to the output negative control signals; and a second output negative switch applying the output voltage of the negative amplifier to the first source line in response to the output negative control signals.

8. The source driver of claim 7, wherein the first output positive switch and the first output negative switch are alternately turned on for respective frames, and the second output positive switch and the second output negative switch are alternately turned on for the respective frames.

9. The source driver of claim 7, wherein, when operation of the source driver is tested through a pad connected to the first source line, an output characteristic of the positive amplifier is tested by turning on the first output positive switch or an output characteristic of the negative amplifier is tested by turning on the second output negative switch.

10. The source driver of claim 7, wherein, when operation of the source driver is tested through a pad connected to the second source line, an output characteristic of the positive amplifier is tested by turning on the first output negative switch or an output characteristic of the negative amplifier is tested by turning on the second output positive switch.

11. The source driver of claim 7, wherein the first input positive switch, the second input positive switch, the first input negative switch, the second input negative switch, the first output positive switch, the second output positive switch, the first output negative switch and the second output negative switch are MOSFETs or transfer gates each having an N-type MOSFET and a P-type MOSFET.

12. The source driver of claim 1, wherein each of the positive amplifier and the negative amplifier is a buffer composed of an operational amplifier.

13. The source driver of claim 1, wherein the display device is a TFT-LCD.

14. A source driver of a display device comprising:

a conversion unit receiving external video data and including a first decoder decoding the received external video data to output a first gray-level voltage corresponding to a driving voltage of a first source line and a second decoder being different from the first decoder and decoding the received external video data to output a second gray-level voltage corresponding to a driving voltage of a second source line adjacent to the first source line;

an amplification unit including a positive amplifier outputting an output voltage having a positive deviation relative to an input voltage applied thereto and a negative amplifier outputting an output voltage having a negative deviation relative to an input voltage applied thereto; and an input controller, coupled between the conversion unit and the amplification unit, for controlling the input to the amplification unit, and an output controller for controlling the output of the amplification unit, wherein the input controller transfers the first gray-level voltage to the positive amplifier, the output controller applies the output voltage of the positive amplifier to the first source line, the input controller transfers the second gray-level voltage to the negative amplifier and the output controller applies the output voltage of the negative amplifier to the second source line when receiving positive control signals, and wherein the input controller transfers the first gray-level voltage to the negative amplifier, the output controller applies the output voltage of the negative amplifier to the first source line, the input controller transfers the second gray-level voltage to the positive amplifier and the output controller applies the output voltage of the positive amplifier to the second source line when receiving negative control signals, wherein the input controller and the output controller remove a display error in pixels connected to the first source line or in pixels connected to the second source line, caused by the positive deviation or the negative deviation, by opening and closing switching elements outside the amplification unit and alternating at consecutive frames the positive deviation and negative deviation applied to the respective first source line and second source line.

15. The source driver of claim 14, wherein the positive control signals are input to the input controller and to the output controller for the Nth frame of the display device and the negative control signals are input to the input controller and to the output controller for the (N+1)th frame of the display device.

16. The source driver of claim 14, wherein the first source line is a selected source line included in the display panel of the display device and the second source line is a source line adjacent to the first source line.

17. The source driver of claim 14, wherein a first input positive switch of the input controller is turned on for transferring the first gray-level voltage to the positive amplifier, a second input positive switch of the input controller is turned on for transferring the second gray-level voltage to the negative amplifier, a first output positive switch of the output controller is turned on for applying the output voltage of the positive amplifier to the first source line, and a second output positive switch of the output controller is turned on for applying the output voltage of the negative amplifier to the second source line when receiving the positive control signals.

18. The source driver of claim 17, wherein the first input positive switch, the second input positive switch, the first input negative switch, the second input negative switch, the first output positive switch, the second output positive switch, the first output negative switch and the second output negative switch are MOSFETs or transfer gates each having an N-type MOSFET and a P-type MOSFET.

19. The source driver of claim 14, wherein a first input negative switch of the input controller is turned on for transferring the first gray-level voltage to the negative amplifier, a second input negative switch of the input controller is turned on for transferring the second gray-level voltage to the positive amplifier, a first output negative switch of the output controller is turned on for applying the output voltage of the positive amplifier to the second source line, and a second output negative switch of the output controller is turned on for applying the output voltage of the negative amplifier to the first source line when receiving the negative control signals.

20. The source driver of claim 19, wherein the first input positive switch, the second input positive switch, the first input negative switch, the second input negative switch, the first output positive switch, the second output positive switch, the first output negative switch and the second output negative switch are MOSFETs or transfer gates each having an N-type MOSFET and a P-type MOSFET.

21. The source driver of claim 14, wherein the positive control signals are input to both the input controller and the output controller, and the negative control signals are input to both the input controller and the output controller, for the respective frames.

22. The source driver of claim 14, wherein each of the positive amplifier and the negative amplifier is a buffer composed of an operational amplifier.

23. A method for driving source lines of a display device using a source driver including a positive amplifier outputting an output voltage having a positive deviation relative to an input voltage applied thereto from an input controller coupled between a first digital-analog converter and the positive amplifier and a negative amplifier outputting an output voltage having a negative deviation relative to an input voltage applied thereto from the input controller coupled between a second digital-analog converter and the negative amplifier comprising:

(a) transferring a first gray-level voltage corresponding to a driving voltage of a first source line to the positive amplifier via the input controller, applying the output voltage of the positive amplifier to the first source line via an output controller, transferring a second gray-level voltage corresponding to a driving voltage of a second source line adjacent to the first source line to the negative amplifier via the input controller, and applying the output voltage of the negative amplifier to the second source line via the output controller; and (b) transferring the first gray-level voltage to the negative amplifier via the input controller, applying the output voltage of the negative amplifier to the first source line via the output controller, transferring the second gray-level voltage to the positive amplifier via the input controller, applying the output voltage of the positive amplifier to the second source line via the output controller, wherein a display error in pixels connected to the first source line or in pixels connected to the second source line, caused by the positive deviation or the negative deviation, is removed by opening and closing switching elements outside the amplifiers and alternating at consecutive frames the positive deviation and negative deviation applied to the respective first source line and second source line and wherein the first gray-level voltage is output to the input controller from the first digital-analog converter that is involved in driving the first source line and that receives external video data, and the second gray-level voltage is output to the input controller from the second digital-analog converter that is different from the first digital-analog converter, that is involved in driving the second source line, and that receives external video data.

24. The method of claim 23, wherein the (a) step is performed for the Nth frame of the display device and the (b) step is performed for the (N+1)th frame of the display device.

25. The method of claim 23, wherein the first source line is an arbitrary source line included in the display panel of the display device and the second source line is a source line adjacent to the first source line.

26. The method of claim 23, wherein the display device as a TFT-LCD.

* * * * *